US010322520B1

(12) United States Patent
Cote

(10) Patent No.: US 10,322,520 B1
(45) Date of Patent: Jun. 18, 2019

(54) PULLEY SYSTEM FOR TRANSFERRING MOTOR TORQUE TO A CUTTING BLADE ASSEMBLY

(71) Applicant: Sylvain Cote, Princeville (CA)

(72) Inventor: Sylvain Cote, Princeville (CA)

( * ) Notice: Subject to any disclaimer, the term of this patent is extended or adjusted under 35 U.S.C. 154(b) by 0 days.

(21) Appl. No.: 15/924,275

(22) Filed: Mar. 19, 2018

(51) Int. Cl.
*B27B 17/08* (2006.01)
*B27B 1/00* (2006.01)
*B27B 17/00* (2006.01)

(52) U.S. Cl.
CPC ..... *B27B 17/08* (2013.01); *B27B 1/00* (2013.01); *B27B 17/0058* (2013.01); *B27B 17/0091* (2013.01)

(58) Field of Classification Search
CPC ..... B27B 17/08; B27B 17/0091; B27B 1/00; B27B 17/0058
See application file for complete search history.

(56) References Cited

U.S. PATENT DOCUMENTS 5,107,594 A * 4/1992 Ferreras ..... B27B 17/0058 30/372
5,161,448 A * 11/1992 Wangsness ..... A01D 87/127 241/605
5,724,876 A * 3/1998 Johnson ..... B27B 17/0058 144/34.1
5,752,892 A * 5/1998 Taomo ..... B27B 17/08 474/112
5,802,946 A * 9/1998 Leini ..... A01G 23/091 144/34.1
5,884,545 A * 3/1999 Hamby, Jr. ..... B27B 1/002 144/245.2
6,068,033 A * 5/2000 Broussard ..... A01G 23/097 144/24.13
6,532,850 B1 * 3/2003 Bergvall ..... B23D 61/126 144/341
7,895,929 B2 3/2011 Zhang
7,913,479 B2 * 3/2011 Eavenson, Sr. ..... A01D 34/76 474/135
8,359,957 B1 * 1/2013 Riha ..... B27B 17/08 30/381
2003/0097917 A1 * 5/2003 Virvalo ..... A01G 23/091 83/74
2009/0205750 A1 * 8/2009 Wright ..... A01G 3/08 144/4.1
2009/0229433 A1 * 9/2009 Kovalenko ..... A01G 23/091 83/13
2009/0272462 A1 * 11/2009 Kauppila ..... A01G 23/095 144/24.13
2011/0253122 A1 * 10/2011 Berglund ..... B27B 17/08 125/21

(Continued)

*Primary Examiner* — Sean M Michalski

(57) ABSTRACT

A pulley system for transferring motor torque to a cutting blade assembly is provided. The system is installed on a log cutting machine. A motor of the log cutting machine is positioned on a support table, which is intended to raise and lower during operation. The cutting blade assembly includes a cutting blade member for cutting a log off a tree trunk. A chain is attached to a cutting blade member and the support table, such that when the cutting blade member is driven downward towards the tree trunk, the connected chain and support table are lowered assisting the actuation of the cutting blade member via the pulley system.

7 Claims, 4 Drawing Sheets

(56) References Cited

U.S. PATENT DOCUMENTS

| | | | | |
|---|---|---|---|---|
| 2012/0111170 | A1* | 5/2012 | Steinfort | B27B 17/0058 83/796 |
| 2012/0180773 | A1* | 7/2012 | Baratta | B27B 17/0083 125/21 |
| 2012/0205009 | A1* | 8/2012 | Barnhill | B25H 1/04 144/286.5 |
| 2013/0248294 | A1* | 9/2013 | Kettunen | F16N 7/38 184/26 |
| 2014/0027019 | A1* | 1/2014 | Ketonen | A01G 23/08 144/336 |
| 2014/0096869 | A1* | 4/2014 | Raunisto | B27B 17/0058 144/4.6 |
| 2015/0343661 | A1* | 12/2015 | Zorn | B27B 17/0058 83/795 |
| 2017/0021522 | A1* | 1/2017 | McCracken | B27B 17/0091 |
| 2017/0120354 | A1* | 5/2017 | Jonsson | B27B 17/0083 |
| 2017/0165827 | A1* | 6/2017 | Smollar | B25H 1/0028 |

* cited by examiner

PULLEY SYSTEM FOR TRANSFERRING MOTOR TORQUE TO A CUTTING BLADE ASSEMBLY

BACKGROUND OF THE INVENTION

1. Field of the Invention

The present invention generally relates to cutting implements but more particularly to a pulley system for transferring motor torque to a cutting blade assembly.

2. Description of Related Art

It is well known that log cutting machines are configured to be permanently installed in a factory or transported on site, usually in a trailer configuration. In both cases, the basic principles of operation are the same. A tree trunk is placed on a carriage, or similar device, that moves the trunk longitudinally until a certain adjustable pre-determined length has been reached, and a cutting blade, similar to a chain saw blade, cuts a log off the trunk. After a first log is cut, the trunk moves again at the pre-determined length so that the next log is cut off, and this process is repeated until the trunk is completely cut into the logs. These logs can later be split so as to make firewood, as well known in the art.

Log cutting machines have an internal combustion engine which drives hydraulic pumps, which then drive the cutting blade as well as move the log and actuate other movable parts such as a trunk stabilizing member to hold the log steady during the cutting operation. This prevents the trunk from rolling off during operation. Since the power of the internal combustion engine loses some of its intrinsic power when actuating the hydraulic pumps, the cutting blade does not cut as fast as it could if it could draw more power from the engine. Consequently, the logs are not cut timely and efficiently.

BRIEF SUMMARY OF THE INVENTION

In one embodiment of the present invention a system is providing, comprising a support table; a motor positioned on the support table, the motor comprising a motor drive shaft forming part of a first pulley, wherein the first pulley is configured to drive a t least one belt in mechanical connection with a second pulley; a cutting blade member connected to the second pulley; a trunk stabilizing member configured to stabilizing a tree trunk; a hydraulic piston configured to actuate the cutting blade member in a downward motion to cut a log off the tree trunk; a chain having an upper end and a lower end, wherein the upper end is attached to the cutting blade member and the lower end is attached to the support table; and, a belt guide having a pair of flaps.

In one embodiment, the chain is configured to be lowered when the cutting blade member is in the downward motion such that the motor and support table are lowered tightening the at least one belt around the first and second pulley. In one embodiment, the belt guide is configured to ensure that when the support table is lowered the at least one belt is guided back onto the first and second pulleys. In one embodiment, the pair of flaps is hingedly connected to a base. In another embodiment, the pair of flaps is configured to prevent the at least one belt from excessive deformation. In yet another embodiment, the pair of flaps is configured to retain the position of the at least one belt during operation when the at least one belt is released from the first and second pulleys when the support table is raised. In one embodiment, the motor drive shaft extends beyond the first pulley to receive a secondary hydraulic pump pulley, wherein the secondary hydraulic pump pulley is connected to a secondary hydraulic pump by way of a belt and the motor drive shaft ends as it connects directly to a primary hydraulic pump.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a pulley system for transferring motor torque to a cutting blade assembly.

Figure 1:
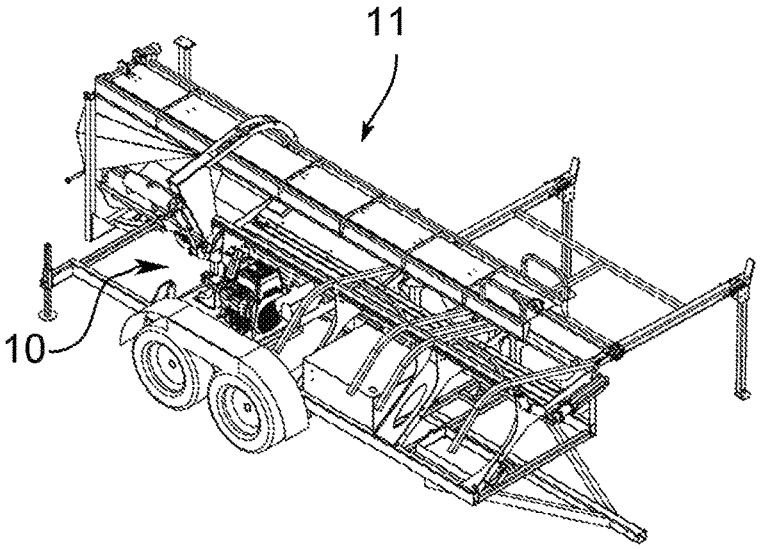
FIG. 1 is an isometric view of a pulley system for transferring motor torque to a cutting blade assembly installed on a log cutting machine according to an embodiment of the present invention.

FIG. 1 is an isometric view of a pulley system 10 for transferring motor torque to a cutting blade assembly 12 installed on a log cutting machine 11 according to an embodiment of the present invention.

Figure 2:
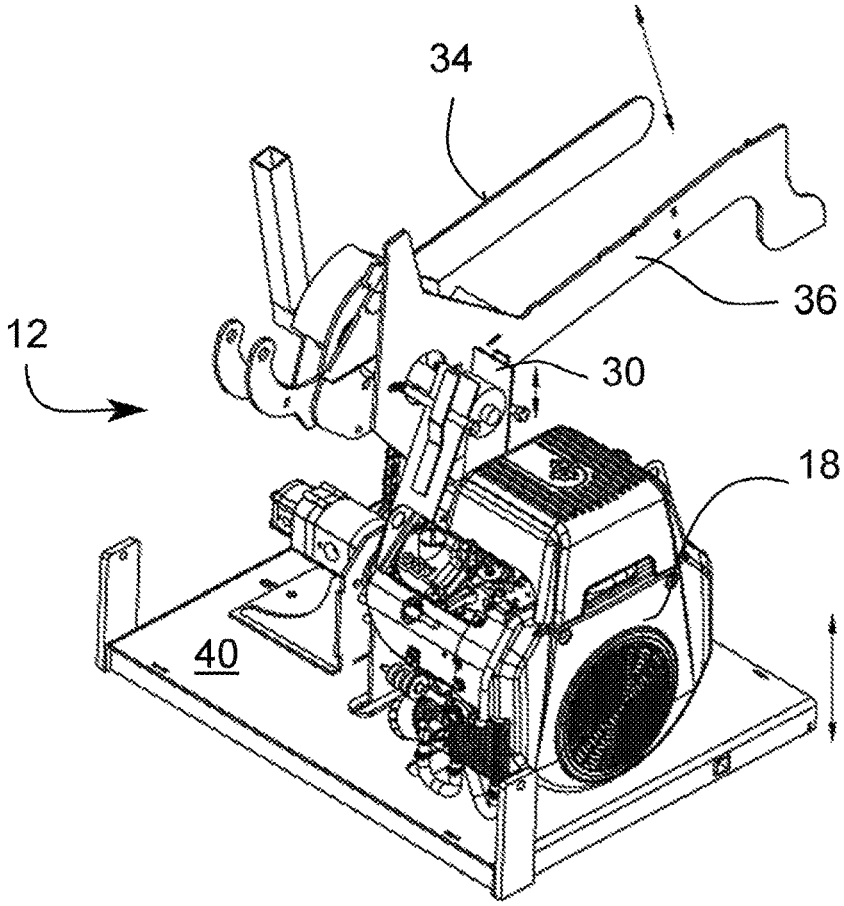
FIG. 2 is an isometric view of a pulley system for transferring motor torque to a cutting blade assembly according to an embodiment of the present invention.
Figure 3:
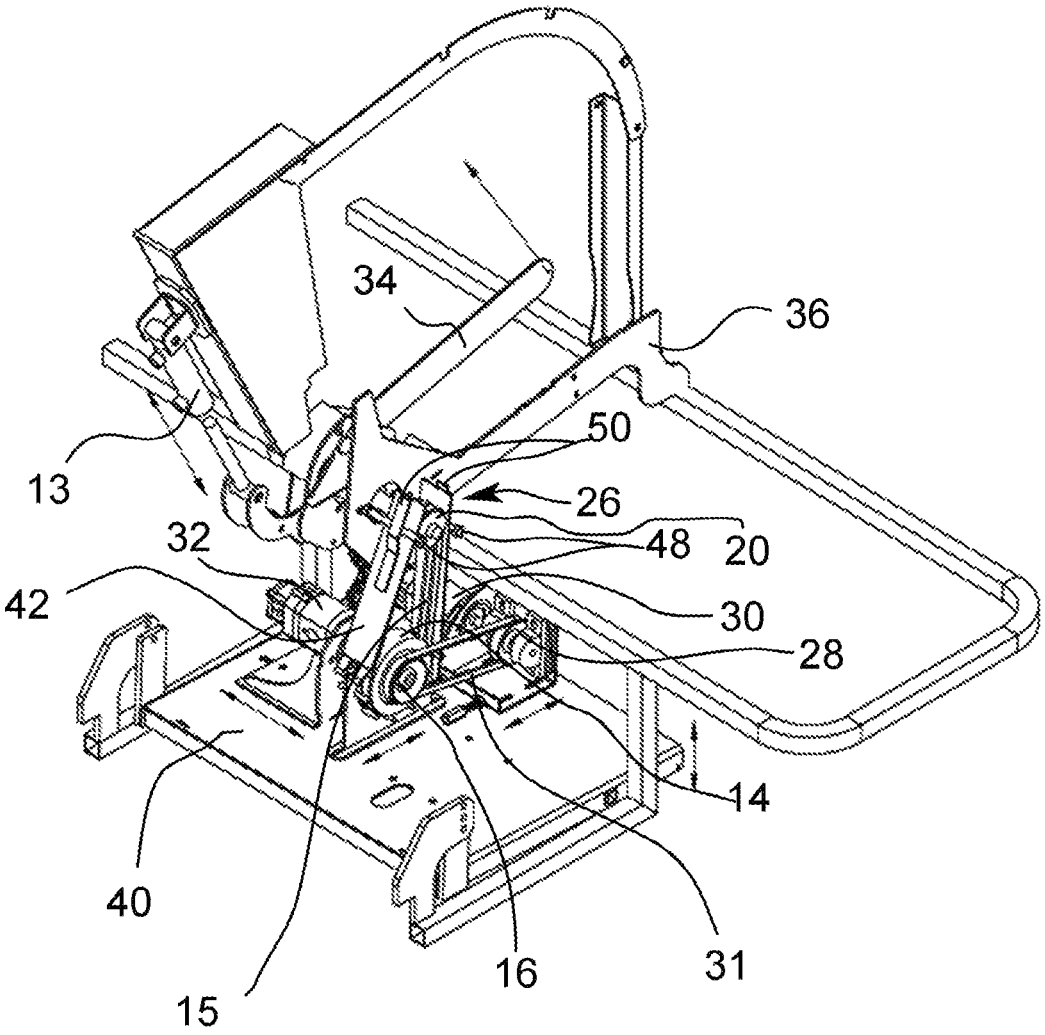
FIG. 3 is a detailed view of FIG. 2 with the motor removed for clarity.
Figure 4A:
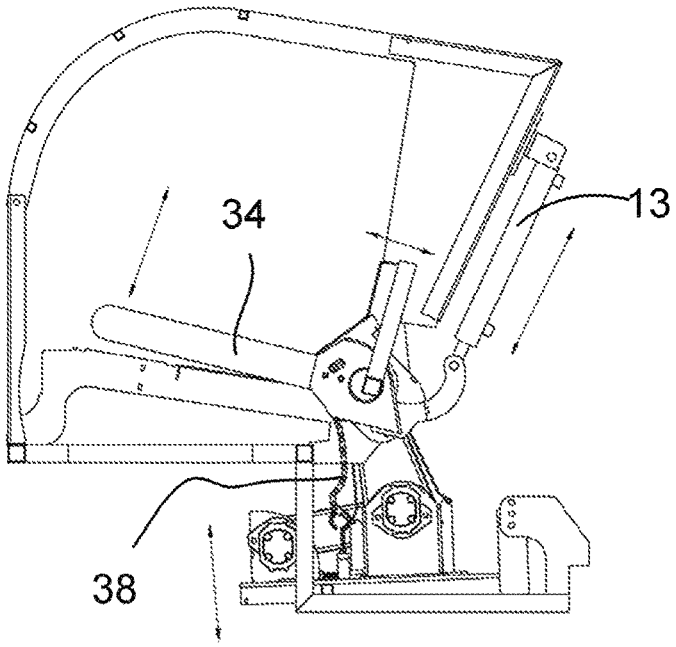
FIGS. 4A-B are side views illustrating the cutting blade assembly in an upward and downward position respectively.
Figure 4B:
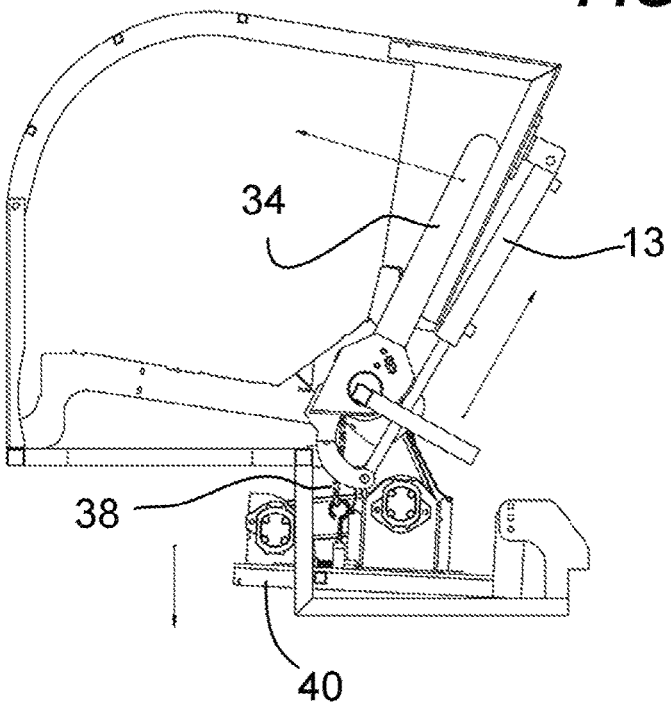

FIGS. 2-4 are various views of the pulley system for transferring motor torque to the cutting blade assembly. In one embodiment, the pulley system is comprised of a first pulley 14 forming part of a motor drive shaft 16, from motor 18. The figures show a double groove pulley, which ensure better traction but one can realize that the invention can work with various types of pulleys. In one embodiment, the first pulley drives at least one belt 15 (two belts here since a double pulley is illustrated) in mechanical connection with a second pulley 20. The second pulley is connected to cutting blade member 34. In one embodiment, belt guide member guides the at least one belt into a given configured when they are disconnected form the first and second pulleys. This will be described in greater detail below.

The motor drive shaft extends beyond the first pulley to take on a secondary hydraulic pump pulley 28 which connects to a secondary hydraulic pump 30 by way of hydraulic belt 31. The motor drive shaft ends as it connects directly to a primary hydraulic pump 32.

[17] In one embodiment, a cutting blade assembly 12 is provided. The cutting blade assembly comprises cutting blade member 34, a trunk stabilizing member 36, and a hydraulic piston 13. During operation, best seen in FIGS. 4A-B, the hydraulic piston actuates the cutting blade member such that the cutting blade member descends in a downwardly motion to cut a log off a tree trunk (not illustrated) as well known in the art. The trunk stabilizing member is configured to stabilize the trunk during cutting. In one embodiment, the hydraulic piston provides the necessary stabilizing force for the trunk stabilizing member to secure the log during cutting. In alternative embodiments, the hydraulic piston may be replaced by manual action. As the cutting blade member is moved in a downward motion, a chain 38 attached to the cutting blade member is also lowered. In one embodiment, an upper end of the chain is attached to cutting blade member 24 and a lower end is attached to support table 40. As the chain is lowered, the motor drops, tightening the at least one belt around the first and second pulleys actuating the cutting blade member.

In one embodiment, a belt guide member 26 is provided to ensure that when the support table is raised, and the at least one belt is released from the first and second pulleys, the at least one belt is guided back onto the first and second pulleys when the support table is lowered again.

Figure 5:
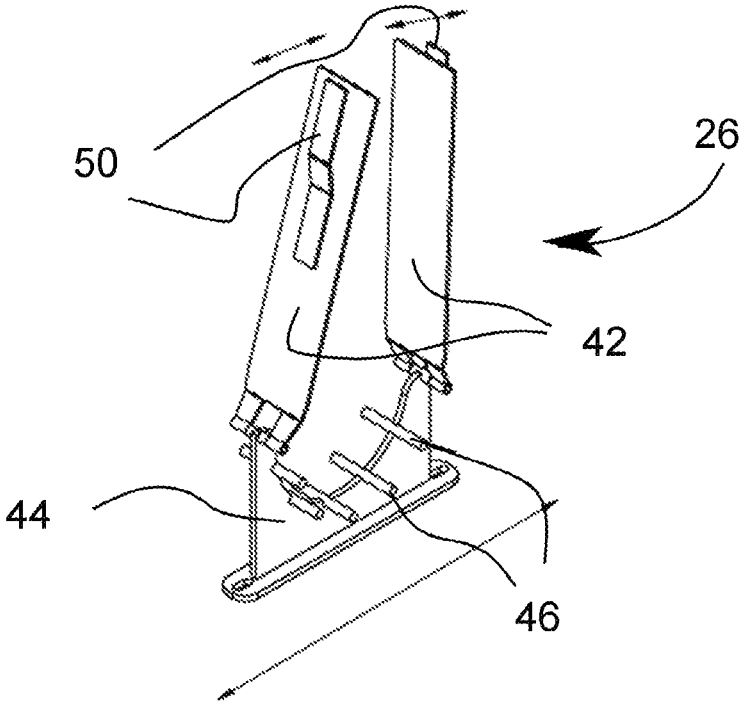
FIG. 5 is a detailed view of a belt guide member of the system according to an embodiment of the present invention.

Best seen in FIG. 5, belt guide member 26 is comprised of a pair of flaps 42 hingedly connected to base 44. The pair of flaps is critical during operation. In one embodiment, the pair of flaps prevents the at least one belt from excessive deformation. In another embodiment, the pair of flaps helps to retain the position of the at least one belt during operation when released from the first and second pulleys. In one embodiment, a plurality of pegs 46 extends perpendicularly from the base, wherein the plurality of pegs secures the at least one belt from a bottom position during operation when released from the first and second pulleys. One the at least one belt are tight around the first and second pulleys, the belt guide member is not in use. It is a particular advantage of the present invention, that the pair of flaps may be opened allowing easy access to the at least one belt for replacement by removing pins 48 (FIG. 3) from staples 50.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For example, the belt and pulleys could be replaced by a drive chain and toothed gears. However, during operation a set of toothed gears and a drive chain could not be effectively used since the chain could still get caught in the teeth of the gears even when loosened, and the retightening process could be difficult when aligning the teeth with the chain, which would be less than ideal It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A system comprising:

a support table;

a motor positioned on the support table, the motor comprising a motor drive shaft forming part of a first pulley, wherein the first groove pulley is configured to drive at least one belt in mechanical connection with a second pulley;

a cutting blade member connected to the second pulley;

a trunk stabilizing member configured to stabilizing a tree trunk;

a hydraulic piston configured to actuate the cutting blade member in a downward motion to cut a log off the tree trunk;

a chain having an upper end and a lower end, wherein the upper end is attached to the cutting blade member and the lower end is attached to the support table; and, a belt guide having a pair of flaps.

2. The system of claim 1, wherein the chain is configured to be lowered when the cutting blade member is in the downward motion such that the motor and support table are lowered tightening the at least one belt around the first and second pulley.

3. The system of claim 2, wherein the belt guide is configured to ensure that when the support table is lowered the at least one belt is guided back onto the first and second pulleys.

4. The system of claim 1, wherein the pair of flaps is hingedly connected to a base.

5. The system of claim 4, wherein the pair of flaps is configured to prevent the at least one belt from excessive deformation.

6. The system of claim 4, wherein the pair of flaps the pair of flaps is configured to retain the position of the at least one belt during operation when the at least one belt is released from the first and second pulleys when the support table is raised.

7. The system of claim 1, wherein the motor drive shaft extends beyond the first pulley to receive a secondary hydraulic pump pulley, wherein the secondary hydraulic pump pulley is connected to a secondary hydraulic pump by way of a hydraulic belt and the motor drive shaft ends as it connects directly to a primary hydraulic pump.

* * * * *